US006340933B1

(12) United States Patent
Chen et al.

(10) Patent No.: US 6,340,933 B1
(45) Date of Patent: Jan. 22, 2002

(54) SEMICONDUCTOR WAFER TRANSPORT POD HAVING COVER LATCH INDICATOR

(75) Inventors: Yi-Jen Chen, Hsin-Chu Tai an; Guey-Shyung Cho, Hsin-Chu, both of (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/450,211

(22) Filed: Nov. 29, 1999

(51) Int. Cl.[7] ..... G08B 21/00

(52) U.S. Cl. ..... 340/687; 340/686.1; 340/680; 340/542; 70/432; 414/935

(58) Field of Search ..... 340/687, 686.1, 340/680, 542; 70/632; 292/2, 33; 414/935

(56) References Cited

U.S. PATENT DOCUMENTS

| | | | | | |
|---|---|---|---|---|---|
| 4,760,380 | A | * | 7/1988 | Quenneville et al. | 340/542 |
| 5,621,387 | A | * | 4/1997 | Phillips | 340/545.6 |
| 5,670,940 | A | * | 9/1997 | Holcomb et al. | 340/543 |
| 5,760,690 | A | * | 6/1998 | French | 340/571 |
| 5,868,803 | A | * | 2/1999 | Chen | 29/25.01 |
| 5,871,063 | A | * | 2/1999 | Young | 180/268 |
| 5,967,571 | A | * | 10/1999 | Gregerson | 292/33 |

* cited by examiner

*Primary Examiner*—Benjamin C. Lee
(74) *Attorney, Agent, or Firm*—Tung & Associates

(57) ABSTRACT

A pod for transporting a cassette containing semiconductor wafers includes a base and a cover removably carried on the base for protectively enclosing the cassette. A latching mechanism for latching the cover on the base is provided with an electrical sensor that senses when the cover is properly latched on the base and controls an electrical light on the base to provide a visual indication of latch status.

17 Claims, 3 Drawing Sheets

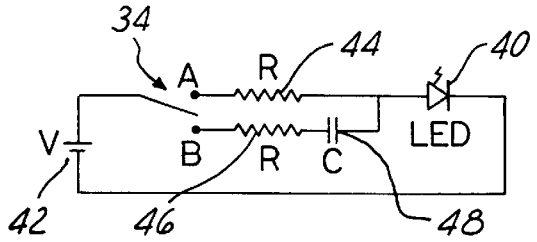
FIG. 4
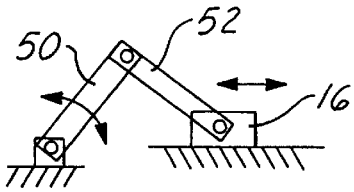
FIG. 5
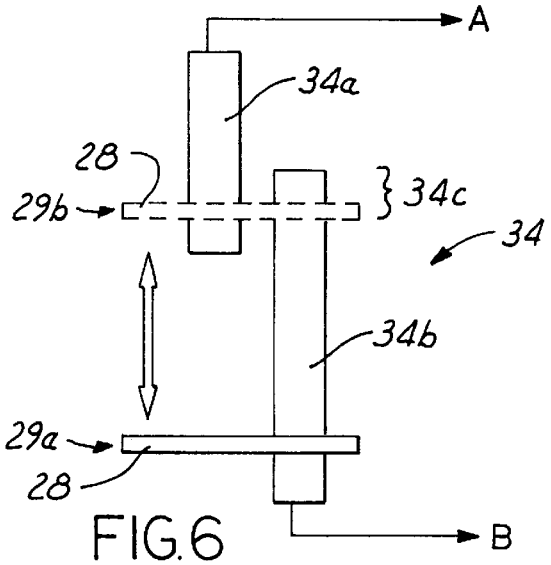
FIG. 6
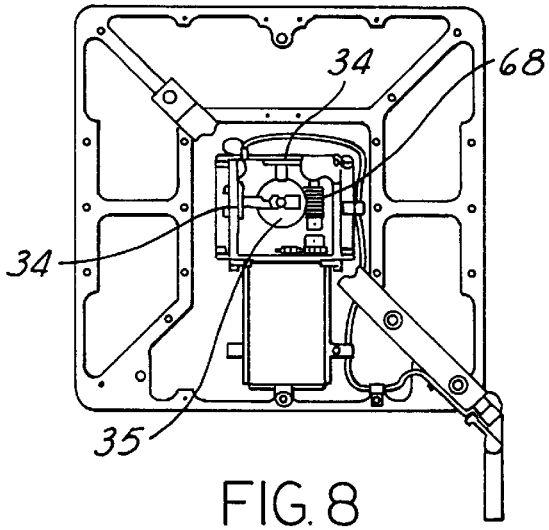
FIG. 8
FIG. 7
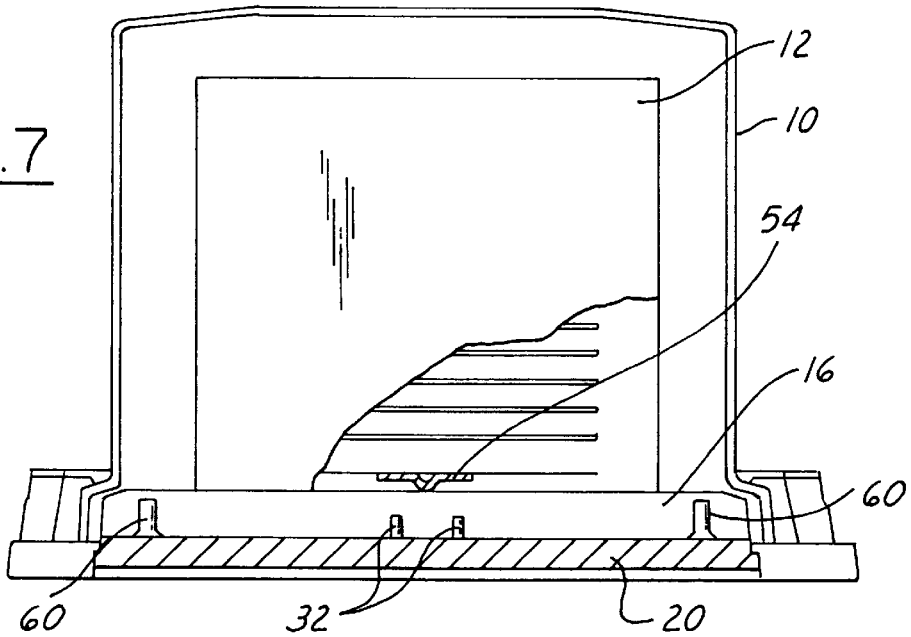

SEMICONDUCTOR WAFER TRANSPORT POD HAVING COVER LATCH INDICATOR

TECHNICAL FIELD

The present invention broadly relates to semiconductor wafer processing equipment, and deals more particularly with an improved pod employed to protectively enclose and transfer a cassette containing a plurality of semiconductor wafers.

BACKGROUND OF THE INVENTION

The high level of automation used in fabricating semiconductor devices relies on sophisticated handling and transport equipment for moving semiconductor wafers between various processing stations. Most handling and transport operations are conducted under automatic control using a programmed computer which issues control signals for operating the equipment with little or no intervention by an operator. In many systems, standard mechanical interface (SMIF) pods are used to transport batches of wafers that are stored in cassettes. These pods include a base upon which the cassettes rest, and a cover removably secured to the base and completely enclosing the cassette. The cover protectively surrounds the cassette, and thus the wafers, from the surrounding environment which may contain airborne, contamination particles. SMIF pods are most often used to transport cassettes from one clean room environment to another, where during the transport movement, the wafers, if not covered, are exposed to the contaminating environment.

After a pod has reached the vicinity of a processing station within a protected, clean room environment, it is necessary to remove the cover so that automated wafer transfer robots can gain access the individual wafers held in the cassette. The covers are held on the pods by various types of latching mechanisms which are automatically actuated to latch and unlatch the cover by means of actuating controls positioned at each processing station. Thus, when a pod reaches a processing station, control mechanisms engage the latch mechanism on the pod to unlatch the cover, following which either an operator or a robotic mechanism removes the cover to expose the cassette. Following processing of a batch of wafers in the cassette, the cover is reinstalled on the pod base, either manually or robotically, after which the control mechanism is actuated to latch the cover on the base before the pod leaves the processing station.

In spite of the fact that positive latch mechanisms are employed to lock the cover on the pod base, occasions arise when, for a variety of reasons, the latch fails to lock the cover on the pod base. This may occur, for example, when a foreign article becomes lodged between the cover and the base or where the cassette becomes tilted on the base, thus interfering with proper seating of the cover. In other cases, the control mechanism for actuating the latch may malfunction. In many cases, failure of the latch mechanism to lock the cover on the pod base goes undetected by process operators. As a result, it is possible that contaminants may pass between the pod base and cover when the pod leaves the clean room environment thereby resulting in possible contamination of the wafers.

Accordingly, there is a clear need in the art for an improved pod construction which provides a positive indication of when the cover is properly locked down on the pod base. The present invention is directed toward satisfying this need in the art.

SUMMARY OF THE INVENTION

The present invention relates to a pod for transporting a cassette containing a plurality of semiconductor wafers. The pod includes a base for supporting the cassette thereon, and a cover removably carried on the base for protectively covering the cassette. Latch means are carried on the base for latching the cover on the base. The latch means is actuatable from a closed, latched position in which the cover is locked down on the base, to a released, open condition allowing the cover to be removed from the base. Means are provided on the base for providing an operator with a positive, visual indication that the latching means has properly locked down the cover on the base. The indicator means includes an electrical power source, preferably a battery, carried on the base, an indicator light such as an LED, and an electrical switch which is actuated by the latch means. The latch means include a pair of slidably latch members on the base which engage and lock the cover, as well as a rotatable drive member on the base which is powered by a separate control mechanism at a processing station. The drive member preferably comprises a rotatable plate having a pair of drive pins on the outer periphery thereof. The latch members each include a slot therein for receiving a corresponding one of the drive pins. The drive pins translate the rotational motion of the drive member to linear motion, causing the latch members to slide in either of two directions respectively corresponding to an open position in which the cover may be removed from the base, and a closed, locked position in which the cover is secured on the base.

Both the drive member and the latch members are formed of electrically nonconductive material, while the drive pins are electrically conductive. The electrical switches used to switch power to the indicator lights are carried on the latch members and are switched by movement of the drive pins which act as electrical contacts.

It is therefore a primary object of the present invention to provide a semiconductor wafer cassette carrying pod that eliminates the possibility of wafer breakage or damage as the result of the failure of a cover to be properly locked to the pod base.

Another object of the invention is to provide a pod of the type mentioned above in which positive locking of the cover on the pod base is confirmed by an indicator light on the pod.

Another object of the invention is to provide a pod as described above wherein the state of the cover latching mechanism is positively displayed in view of an operator.

A still further object of the invention is to provide a pod as described above in which the indicator employs a latch sensing system that is simple and economical in design, and which may be retrofitted to existing pods.

These, and further objects and advantages of the present invention will be made clear or will become apparent during the course of the following description of a preferred embodiment of the present invention.

BRIEF DESCRIPTION OF THE DRAWINGS

In the drawings, which form an integral part of the specification, and are to be read in conjunction therewith, and in which like components are designated by identical numerals in the various views:

FIG. 4 is a schematic diagram of the sensing and indicator circuit that form part of the pod of FIG. 2;

FIG. 5 is a diagrammatic view showing the translation of mechanical movement between the drive member and latch members;

FIG. 6 is a diagrammatic view of the electrical switch forming part of the indicator employed in the pod of the present invention, the ultimate position of the driving pin being indicated in the phantom;

FIG. 7 is a front view of the pod of the present invention, parts being broken away in section for clarity;

FIG. 8 is a view similar to FIG. 2 but showing the details of the bottom of the pod, a cover plate having been removed therefrom;

DETAILED DESCRIPTION OF THE PREFERRED EMBODIMENT

Figure 1:
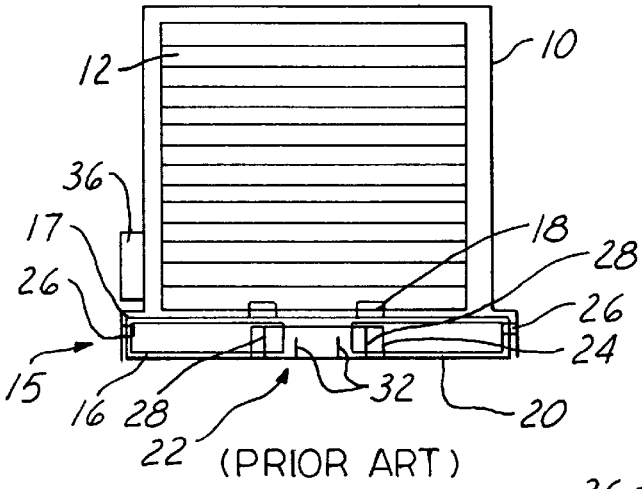
(PRIOR ART) FIG. 1
FIG. 1 is a front, elevational view of a semiconductor wafer pod according to the prior art.

Referring first to FIG. 1, in accordance with the prior art, a pod includes a generally rectangular base 15 upon which there is supported a cassette 12 containing a plurality of vertically spaced, semiconductor wafers (not shown) disposed in stacked relationship to each other. The pod also includes a cover 10 disposed over and protectively enclosing the cassette 12. The cover 10 is provided with a peripheral flange 17 which engages an edge of the base 15, so that the cover 10 is carried on the base 15. A tag 36 is secured to one face of the cover 10 and is used to identify the pod and/or its contents. The tag 36 may comprise a simple bar code device or, an electronic device that can be automatically read by an electronic reader.

The cassette 12 is held on the base 15 by means of an H Bar 18. The H Bar 18 forms a part of the top side of the base, and cooperates to receive a locking member on the base of the cassette 12, in a bayonet like manner.

The base 15 includes a pair of outwardly slidably latch plates 16 having outer fingers 26 which are received in indentations or other recesses (not shown) on the inside wall of the cover 10 in order to lock the cover 10 on the base 15. The latch plates 16 are driven by a circular rotatable plate 24 having a pair of drive pins 28 on the outer periphery thereof. The drive pins 28 are received within elongated slots (not shown) respectively in the latch plates 16. The circular plate 24 is in turn driven by a pair of latch pins 42 that are driven to rotate by other apparatus present at the processing station (not shown) where the pod is delivered in order to load or unload wafers therefrom. Rotation of the plate 24 causes the drive pins 28 to move the latch plate 16 outwardly so that the fingers 26 move into retainers or indentations in the cover 10, thereby latching the latter in place. However, in the event of slight misalignment or tilting of the cover 10 relative to the base 15, or where there is a failure of any of the mechanical driving components, the cover 10 may fail to be properly latched down onto the base assembly 15 but such latching failure is not readily detectable by an operator.

Figure 2:
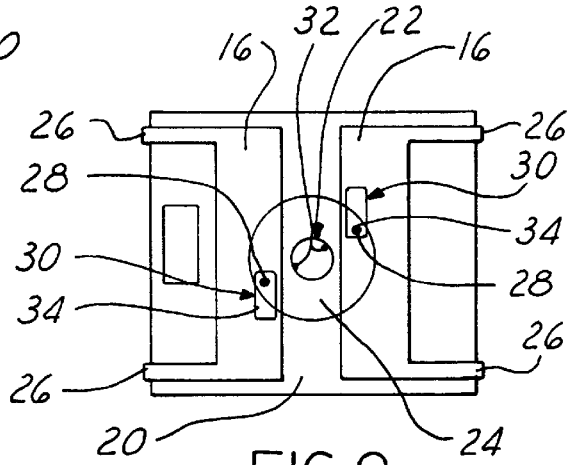
FIG. 2 is a bottom plan view of a semiconductor carrying pod in accordance with the preferred embodiment of the present invention.
Figure 3:
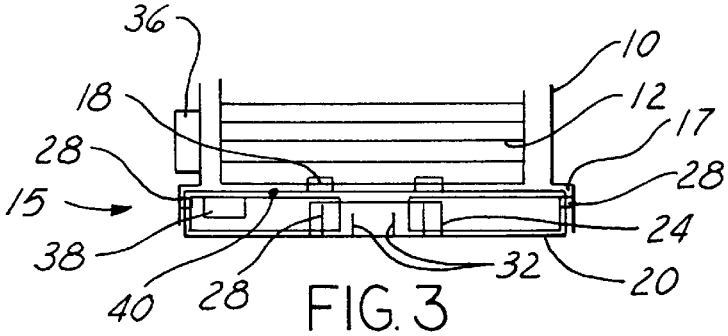
FIG. 3 is a fragmentary, front view of the pod of FIG. 2.

Referring now to FIGS. 2, 3, and 5, the present invention contemplates an improved pod of the type generally discussed with reference to FIG. 1, but containing several novel features that assure that improperly latched down covers 10 will not go undetected. As best seen in FIG. 2, the rotatable plate 24 is generally circular and contains the central latch pin hole 22 in the center thereof. Latch pins 32 are secured on the inner periphery of hole 22. The drive pins 28 are fixed to the periphery of the circular plate 24, on diametrically opposite sides of the latter. Drive pins 28 extend up through and are received within elongated slots 30 defined in the latch plates 16. The application of a rotary force via latch pins 32 is transmitted through plate 24 to drive pins 28. Rotation of latch pins 28 drives the latter to one end of the slots 32. As plate 24 continues to rotate, drive pin 28 force latch plates 16 outwardly, thus converting the rotation of drive force applied to latch pins 32, to linear sliding motion of latch plates 16. This transitional motion is diagrammatically shown in FIG. 5. The rotational motion of plate 24 indicated as the link 50 and 52 is translated to linear motion of the link plate 16.

Figure 9:
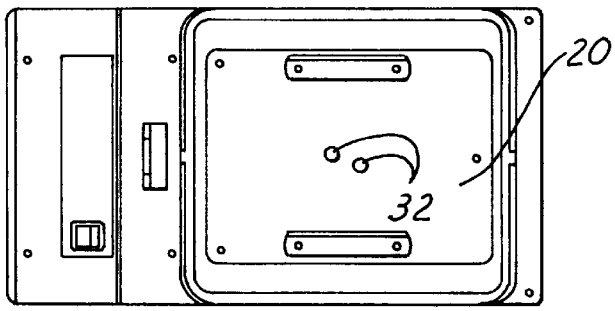
FIG. 9 is a bottom view of the pod shown in FIG. 7.

Additional details of the pod are shown in FIGS. 7–9. As seen in FIG. 7, the cassette 12 is provided with a female locking member 54 which is received within a bayonet-like fixture 18 defined on the upper surface of the base plate 16. The bottom of the base 15 is enclosed by a cover plate 20 having openings through which latch pins 32 and registration pins 60 extend. As shown in FIG. 8, mechanism for rotating the drive pins 32 include a worm gear 68 engaging a gear member 35.

In accordance with the present invention, sensing means are provides for sensing when the cover 10 is positively latched down on the base 15, and for providing a visual indication of whether the cover is in its latched, locked position, or its released, open position. The sensing means includes a pair of electrical switches 34 (FIGS. 2, 4, and 6) which respectively utilize the drive pins 28 as a moveable switch element for establishing a circuit between two electrical contacts that may be in the form of, for example, a pair of flat conductors 34*a*, 34*b* which overlap at 34*c*. The contacts 34 and 34*b* are carried on the latch plates 16, adjacent to slots 30 so that drive pins 28 act as wipers which respectively shift, as plate 24 rotates, from a first position 29*a* (FIG. 6) in which the switch is open, to a second position 29*b* in which the electrically conductive pin 28 makes simultaneous contact with the contacts 34*a*, 34*b*, thereby closing the circuit between these two contacts.

As shown in FIG. 4, contact 34*a* is coupled through a resistor 44 to a light emitting diode (LED) 40, while contact 34*b* is likewise coupled through a resistor 46 as well as a capacitor 48 to the LED 40. The LED 40 is coupled in series with a DC voltage source 42 which is in turn connected with the drive pin 28 which forms part of the switch 34. The DC power source 42 may comprise a simple battery mounted on a convenient location on the base 15 of the pod. Preferably, the battery 42 along with the remainder of the circuit shown in FIG. 4 is mounted on a circuit board 38 secured to the base 15. The LED 40 is likewise secured to an exterior surface of the base 15 so as to be readily visible to an operator.

Figure 10:
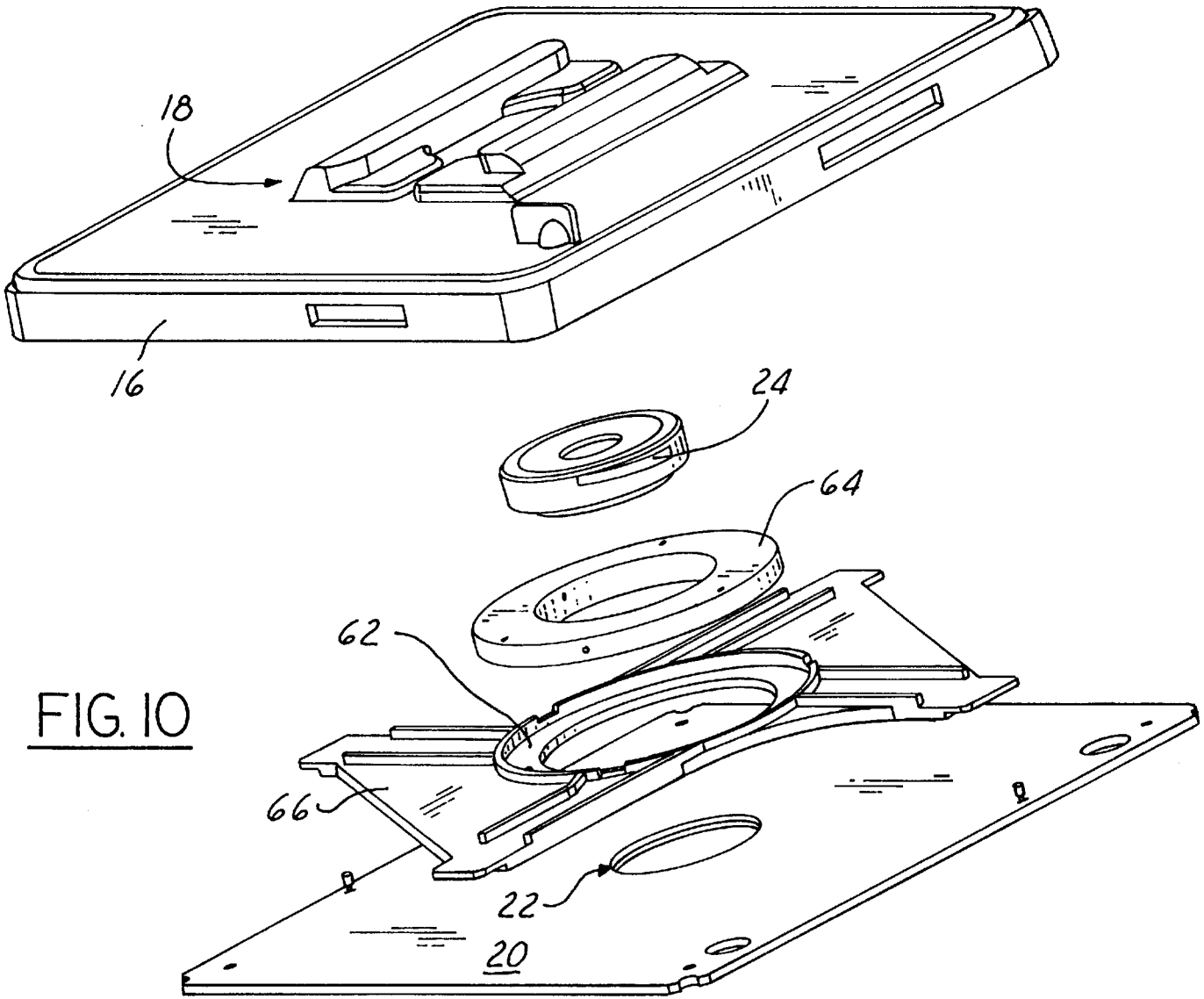
FIG. 10 is an exploded, perspective view of the base forming part of the pod.

FIG. 10 depicts certain details of one embodiment of the base assembly 15. As previously noted, the base plate 16 has formed on the top thereof the H Bar mount 18 for holding the cassette 12. Sandwiched between the base plate 16 and bottom plate 20 is the circular drive plate 24 which is journaled for rotation in a hub 64 that is secured within an annular recess 62 of the support 60.

Both the rotating plate 24 and the latch plate 16 are formed of an electrically nonconductive material, thus insulating the switch 34, including the drive pins 28, from the surrounding components.

From the foregoing, it may be appreciated that the improved pod described above not only provides for the reliable accomplishment of the objects of the invention, but it does so in a particularly economical and efficient manner. It is recognized, of course, that those skilled in the art may make various modifications or additions chosen to illustrate the invention without departing from the present contribution to the art. Accordingly, it is to be understood that the protection sought and to be afforded hereby should be deemed to extend to the subject matter claimed and all equivalents thereof fairly within the scope of the invention.

What is claimed is:

1. A pod for transporting a cassette of semiconductor wafers, comprising:

a base for supporting said cassette thereon;

a cover removably carried on said base for protectively covering said cassette;

latch means carried on said base for latching said cover on said base, said latch means being actuatable from a latched condition in which said cover is latched said base to a released condition allowing removal of said cover from said base, said latch means includes a latch member shiftably mounted on said base, a drive plate and a drive pin carried on said plate, said drive pin being drivable by said plate to shift said latch member for latching and unlatching said cover; and indicator means coupled with said latch means for providing a visual indication of the condition of said latch means, said indicator means includes means responsive to the position of said drive pin to produce an electrical signal related to the condition of said latch means.

2. The pod of claim 1, wherein said indicator means includes lamp means having a first visual state indicating said latched condition and a second visual state indicating said released condition.

3. The pod of claim 1, wherein said signal producing means includes an electrical switch actuatable by movement of said drive pin.

4. The pod of claim 3, wherein said switch includes at least one electrical contact carried on said latch member.

5. The pod of claim 4, wherein said drive plate is generally circular in shape and said drive pin is mounted on the outer periphery of said drive plate.

6. The pod of claim 3, wherein said signal producing means includes an electrical power source carried on said base.

7. The pod of claim 1, wherein said indicator means includes:

switch means operated by the actuation of said latch means, an electrical power source carried on said base, and an indicator lamp coupled in circuit with said switch means and said power source.

8. The pod of claim 1, wherein said latch member is provided with a cam slot therein, said drive pin extends through and is guided within said slot, and said signal producing means includes an electrical power source and switch means operated by said drive pin.

9. The pod of claim 1, wherein said latch member and said drive plate are formed of electrically nonconductive material, and said drive pin is electrically conductive, and wherein said signal producing means includes electrical switch contacts carried on said latch member and operated by said drive pin.

10. A pod for transporting a cassette containing a plurality of semiconductor wafers, comprising:

a base for supporting said cassette thereon;

a cover removably carried on said base for protectively covering said cassette;

latch means carried on said base for latching and unlatching said cover on said base, said latch means includes a latch member latchable with said cover and formed of electrically nonconductive material, and a shiftable drive pin driving said latch member and formed of electrically conductive material, said switch means includes electrical contacts carried on said latch member and contactable by said drive pin; and means for sensing and issuing a visual indication when said cover is latched on said base, said sensing means includes an electrical power source, an indicator lamp, and electrical switch means coupled with said power source and said indicator lamp, and actuated by said latch means.

11. The pod of claim 10, wherein said latch means includes a rotatable drive member formed of electrically nonconductive material and said drive pin is mounted on said rotatable drive member.

12. A pod for transporting a cassette containing a plurality of semiconductor wafers, comprising:

a base for supporting said cassette thereon;

a cover removably carried on said base for protectively covering said cassette;

a pair of latch members shiftably mounted on said base for releasably latching said cover on said base;

means for driving each of said latch members between a first position latching said cover on said base and a second position releasing said cover for removal from said base; and, first and second sensor means carried on said base for respectively sensing the positions of said latch members and for generating a pair of signals related to the sensed positions of said latch members.

13. The pod of claim 12, wherein each of said sensor means includes an electrical switch having contact means carried on one of said latch members.

14. The pod of claim 13, including means electrically responsive to each of said sensor means for generating a visual indication of the sensed positions of said latch members.

15. The pod of claim 13, wherein each of said latch members is formed of an electrically nonconductive material, and said driving means includes a rotatable drive member, said first and second sensor means respectively including first and second electrically conductive pins carried on said drive member for driving said latch members and establishing electrical contact with said electrical switches.

16. The pod of claim 15, wherein said drive member is formed of an electrically nonconductive material.

17. The pod of claim 15, wherein each of said latch members includes a slot therein and wherein said drive pin are respectively received within said slots.

* * * * *